US008217877B2

(12) United States Patent
Fukutome

(10) Patent No.: US 8,217,877 B2
(45) Date of Patent: Jul. 10, 2012

(54) DISPLAY DEVICE, DRIVING METHOD THEREOF, AND ELECTRONIC DEVICE USING THE DISPLAY DEVICE

(75) Inventor: Takahiro Fukutome, Tochigi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 933 days.

(21) Appl. No.: 12/249,777

(22) Filed: Oct. 10, 2008

(65) Prior Publication Data

US 2009/0184911 A1 Jul. 23, 2009

(30) Foreign Application Priority Data

Oct. 19, 2007 (JP) ..... 2007-271896

(51) Int. Cl.
*G09G 3/36* (2006.01)

(52) U.S. Cl. ..... 345/92; 345/87; 345/90; 345/94

(58) Field of Classification Search ..... 345/82, 345/87, 88, 89, 90, 92, 93, 98, 100, 103, 345/204

See application file for complete search history.

(56) References Cited

U.S. PATENT DOCUMENTS 6,982,690 B2 * 1/2006 Lee et al. ..... 345/87
7,212,183 B2 * 5/2007 Tobita ..... 345/93
7,224,333 B2 * 5/2007 Yamazaki et al. ..... 345/82
7,301,517 B2 11/2007 Hebiguchi
7,724,229 B2 * 5/2010 Yoshihara et al. ..... 345/97
2003/0210218 A1 11/2003 Hebiguchi

FOREIGN PATENT DOCUMENTS

JP 57-169795 10/1982
JP 2003-255903 9/2003
JP 2004-037905 2/2004
JP 2006-251322 9/2006

OTHER PUBLICATIONS

Kim, S. S. "Super PVA Sets New State-of-the-Art for LCD-TV", SID 2004 International Symposium Digest of Technical Papers, 2004, 35, 760-763.
International Search Report dated Nov. 4, 2008 for Application No. PCT/JP2008/068318, 4 pages.
Written Opinion dated Nov. 4, 2008 for Application No. PCT/JP2008/068318, 4 pages.

* cited by examiner

*Primary Examiner* — Nitin Patel
*Assistant Examiner* — Sahlu Okebato
(74) *Attorney, Agent, or Firm* — Fish & Richardson P.C.

(57) ABSTRACT

A display device is provided in which a signal line can be shared by a plurality of pixels and data supplied from scan lines can be distributed to a desired pixel selected from the plurality of pixels. The display is characterized in its circuit structure of the plurality of pixels, which allows the signal line to be shared by neighboring three pixels. This circuit structure results in the reduction of the number of signal lines and the simplification of the structure of the signal line driver circuit, which contributes to the reduction of the power consumption and miniaturization of the signal line driver circuit. The detailed structure of the display device is defined in the specification.

16 Claims, 13 Drawing Sheets

DISPLAY DEVICE, DRIVING METHOD THEREOF, AND ELECTRONIC DEVICE USING THE DISPLAY DEVICE

TECHNICAL FIELD

The present invention relates to a display device and a driving method thereof, and an electronic device using the display device.

BACKGROUND ART

A display device is used for various electronic products such as a mobile phone, a television receiver, and the like. A manufacturing process, a driving method, and the like of a display device is researched and developed in order to enlarge the screen and to obtain high definition.

Product development of a display device by increase in the number of pixels to enhance resolution is very active. Although resolution of the display device can be enhanced by increase in the number of pixels, the number of signal lines also increases with increase in the number of pixels. Therefore, as a countermeasure against increase of the signal lines, patent document 1 (Japanese Published Patent Application No. 2003-255903) discloses a structure that a decoder is provided in a pixel portion, and data in signal lines are distributed by the decoder circuit, and a signal line is shared between a plurality of pixels, whereby the number of signal lines is reduced.

DISCLOSURE OF INVENTION

As for the display device disclosed in the patent document 1, a structure is disclosed in which data in signal lines are distributed based on the logic of the signal which is input from two scan lines at the decoder portion provided in the pixel portion, and a signal line is shared with a plurality of pixels. However, the display device disclosed in the patent document 1 has such a problem that a circuit included in the pixel is complex depending on a circuit in the decoder portion. Further, since the decoder portion is connected to a transistor for selecting a pixel, and the decoder portion is necessarily provided in addition to the transistor for selecting the pixel, a problem of increase in the number of elements included in the pixel is caused.

In view of the above problems, it is an object of the present invention to provide a display device and a driving method thereof, which can distribute data in signal lines without adding circuits other than a transistor for selecting a pixel and in which a signal line can be shared between the plurality of pixels.

In order to solve the above problems, the inventor has conceived an idea that, in a display device, a first transistor and a second transistor which are used to select a pixel provided in a pixel portion are provided in series electrically, and respective transistors are controlled by respective scan lines. Specifically, in the display device of the present invention, a plurality of pixels which each include a first transistor of which a first terminal is connected to a signal line and a second transistor of which a first terminal is connected to a second terminal of the first transistor and of which a second terminal is connected to a display element are provided corresponding to a color element. The plurality of pixels corresponding to the color element include a first pixel having a gate of the first transistor connected to a first scan line and having a gate of the second transistor connected to a second scan line, a second pixel having a gate of a first transistor connected to the first scan line and having a gate of a second transistor connected to the first scan line, and a third pixel having a gate of a first transistor connected to the second scan line and having a gate of a second transistor connected to the second scan line. As a result, data in signal lines can be distributed without adding circuits other than the transistor for selecting a pixel, and a signal line can be shared with a plurality of pixels.

Note that when a transistor is used for a pixel, polarity (conductivity type) of a transistor is not limited in particular because the transistor operates just as a switch. Note that by using a transistor having a lightly doped drain region (LDD region) or a transistor having a multi-gate structure as a transistor, current which flows when a transistor is in off state can be reduced.

Note that description that "A and B are connected" denotes a state that A and B are electrically connected.

Note that a display device having a display element can have a liquid crystal element or a light emitting element as a display element; however, the present invention is not limited to these elements. For example, as a display element, an EL element (e.g., an EL element including organic and inorganic materials, an organic EL element, or an inorganic EL element), an electron emitter, electronic ink display, an electrophoresis element, a grating light valve (GLV), a plasma display panel (PDP), a digital micromirror device (DMD), a piezoelectric ceramic display, or the like can be used.

Note that various types of transistors can be used as a transistor. Therefore, there is no limitation to the kinds of transistors to be used. For example, a thin film transistor (TFT) including amorphous silicon, polycrystalline silicon, microcrystalline (also referred to as semi-amorphous) silicon, single crystal silicon, or the like can be used. Alternatively, a transistor including a compound semiconductor or an oxide semiconductor such as ZnO, a-InGaZnO, SiGe, GaAs, furthermore, a thin film transistor obtained by thinning such the compound semiconductor or the oxide semiconductor can be used. Thus, manufacturing temperature can be decreased and for example, a transistor can be formed at room temperature.

Note that one pixel corresponds to one element whose brightness can be controlled. Therefore, for example, one pixel means one color element by which brightness is expressed. Therefore, in the case of a color display device with color elements of R (red) G (green) and B (blue), a minimum unit of an image is composed of three pixels of an R pixel, a G pixel, and a B pixel. Note that the color element may be another color except R, G, and B. For example, three pixels may include pixels of yellow, cyan, and magenta.

Note that pixels may be provided (arranged) in matrix. Here, description that pixels are provided (arranged) in matrix includes the case where the pixels are provided in a straight line and the case where the pixels are provided in a jagged line, in a longitudinal direction or a lateral direction. Thus, for example, in the case of performing full color display with three color elements (e.g., R, G, and B), the case where pixels are provided in stripe arrangement and a case where dots of the three color elements are provided in delta arrangement are included.

Note that a transistor is an element having at least three terminals of a gate, a drain, and a source. The transistor includes a channel region between a drain region and a source region, and current can flow through the drain region, the channel region, and the source region. Here, since the source and the drain may change depending on the structure, the operating condition, and the like of the transistor, it is difficult to define which is the source or the drain. Therefore, in this document (a specification, claims, drawings, and the like), a region functioning as a source or a drain is not referred to as the source or the drain in some cases. In such a case, for example, one of the source and the drain may be referred to as a first terminal and the other may be referred to as a second terminal. Alternatively, one of the source and the drain may be described as a first electrode and the other may be described as a second electrode. Further alternatively, one of the source and the drain may be described as a source region and the other may be described as a drain region.

Note that a display element corresponds to an optical modulation element, a liquid crystal element, a light emitting element, an EL element (an organic EL element, an inorganic EL element, or an EL element including both organic and inorganic materials), an electron emitter, an electrophoresis element, a discharging element, a light-reflective element, a light diffraction element, a digital micromirror device (DMD), or the like. However, the display element is not limited to them.

Note that a display device corresponds to a device having a display element. Note that the display device may include a plurality of pixels including a display element. Note that the display device may also include a peripheral driver circuit for driving the plurality of pixels. Note that the peripheral driver circuit for driving the plurality of pixels may be formed over the same substrate as the plurality of pixels. Note that the display device may also include a peripheral driver circuit provided over a substrate by wire bonding or bump bonding, namely, an IC chip connected by a chip on glass (COG) technique or an IC chip connected by TAB or the like. Note that the display device may also include a flexible printed circuit (FPC) to which an IC chip, a resistor element, a capacitor element, an inductor, a transistor, or the like is attached. Note that the display device also includes a printed wiring board (PWB) which is connected through a flexible printed circuit (FPC) and to which an IC chip, a resistor element, a capacitor element, an inductor, a transistor, or the like is attached.

In accordance with the present invention, data in signal lines can be distributed without adding circuits other than a transistor for selecting a pixel, and a signal line can be shared with the plurality of pixels. Therefore, while quality of display is maintained, the number of signal lines can be reduced and the structure of a signal line driver circuit can be simplified, whereby cost of parts can be easily reduced and the size and power consumption of a signal line driver circuit can be reduced.

BEST MODE FOR CARRYING OUT THE INVENTION

Embodiment Mode

Figure 1:
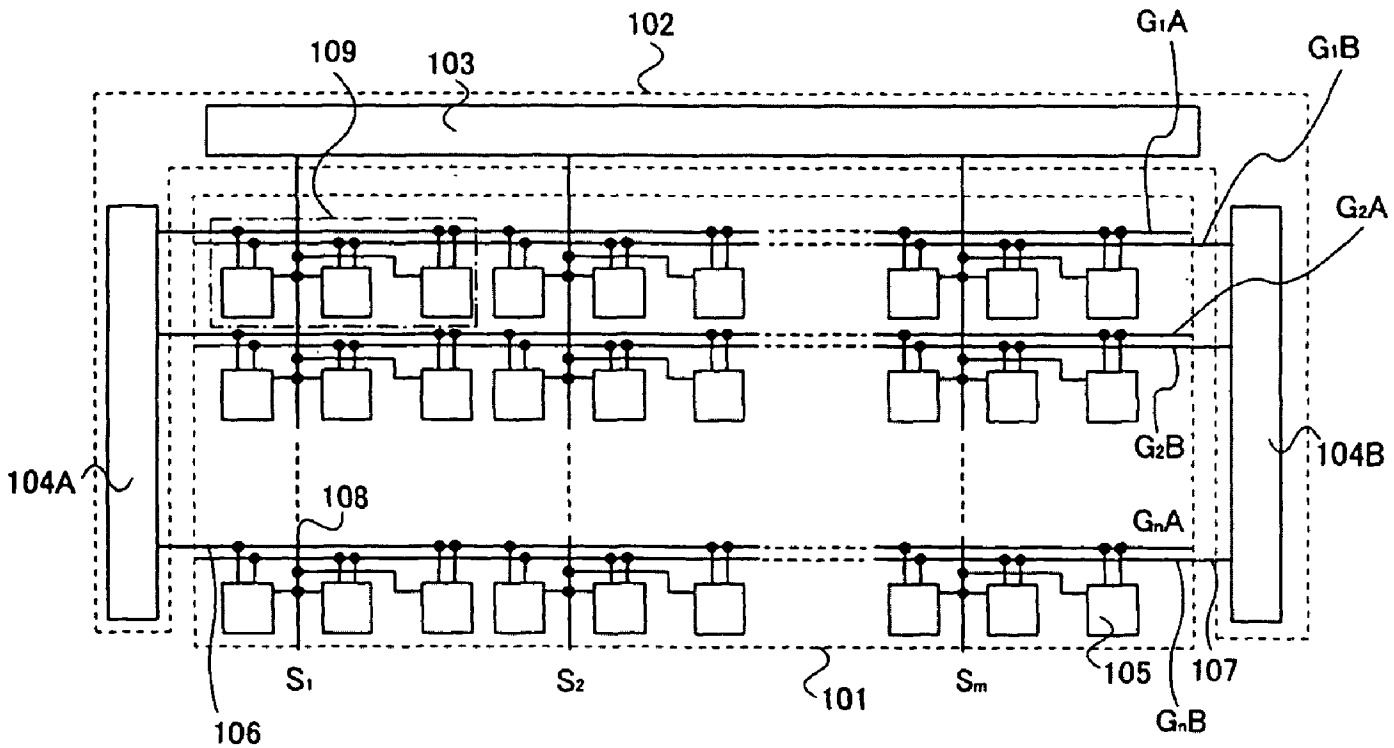
FIG. 1 is a diagram illustrating a display device of the present invention.

Hereinafter, the embodiment modes of the present invention will be described with reference to the drawings. However, the present invention can be implemented in various modes, and it is easily understood by those skilled in the art that modes and details can be variously changed without departing from the scope and the spirit of the present invention. Therefore, the present invention is not construed as being limited to description of the embodiment modes. Note that in the drawings in this specification, the same reference numerals are used for the same portions and portions having similar functions, and description thereof is omitted.

(Embodiment Mode 1)

FIG. 1 illustrates a structure of a block diagram of a display device. FIG. 1 illustrates a structure of a display portion 101 and a driving portion 102 which are included in the display device of the present invention. The driving portion 102 includes a signal line driver circuit 103, a first scan line driver circuit 104A, and a second scan line driver circuit 104B. In the display portion 101, a plurality of pixels 105 are provided in matrix.

Note that description that pixels are provided in matrix includes the case where the pixels are provided in a straight line and the case where the pixels are provided in a jagged line, in a longitudinal direction or a lateral direction. Thus, for example, in the case of performing full color display with pixels which express three color elements (e.g., R, G, and B), a case where pixels are provided in stripe arrangement and a case where pixels which express the three color elements are provided in a delta arrangement are included.

In FIG. 1, a first scan signal is supplied from the first scan line driver circuit 104A to a first scan line 106 (also referred to as a first wiring). Further, a second scan signal is supplied from the second scan line driver circuit 104B to a second scan line 107 (also referred to as a second wiring). Further, image data (hereinafter, simply referred to as data) is supplied from the signal line driver circuit 103 to a signal line 108. Scan signals from the first scan line 106 and the second scan line 107 are supplied in such a manner that the pixels 105 are sequentially selected from the first row of the first scan line 106 and second scan line 107. In addition, the scan signals supplied from the first scan line 106 and the second scan line 107 determine whether the pixels 105 are in selection state or non-selection state row-by-row basis, and further, selection is performed in the pixels 105 (a pixel group 109 in FIG. 1) which are connected to the signal line 108.

Note that in FIG. 1, the first scan line driver circuit 104A is connected to n piece of first scan lines 106 which are from $G_1A$ to $G_nA$, and the second scan line driver circuit 104B is connected to n piece of second scan lines 107 which are from $G_1B$ to $G_nB$. Further, the signal line driver circuit 103 is connected to m piece of signal lines 108 which are from $S_1$ to $S_m$. In the display portion 101, the plurality of pixels 105 are provided in matrix.

Note that a first pixel, a second pixel, and a third pixel in the pixel group 109 are connected to the signal line 108. The first pixel, the second pixel, and the third pixel corresponds to their respective color elements of R (red), G (green), and B (blue) and are combined for controlling the brightness, so that desired color can be expressed. Note that a set of color elements is not limited to the combination of R, G, and B, but may also be the combination of Y (yellow), C (cyan), and M (magenta).

Note that in this specification, one pixel represents one color element, and expresses brightness of one color element. For example, in the case of a color display device with color elements of R, G, and B, a minimum unit of an image is composed of three pixels of an R pixel, a G pixel, and a B pixel.

Figure 13A:
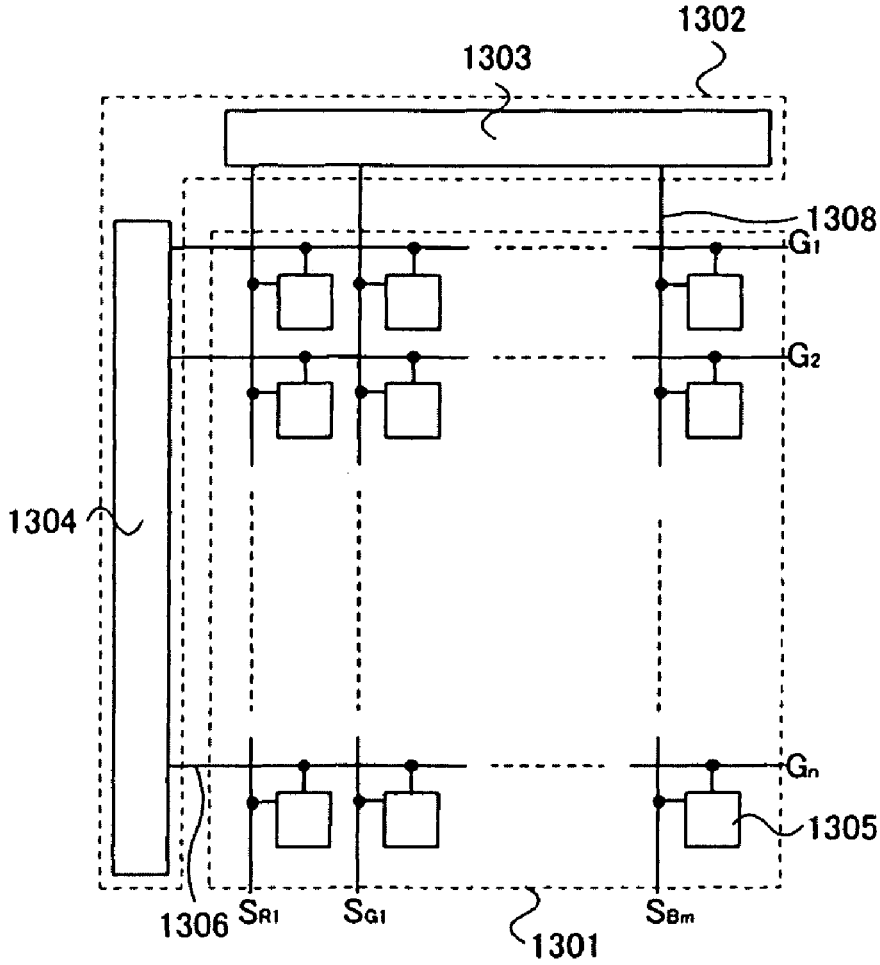
FIGS. 13A and 13B are diagrams illustrating a conventional display device.
Figure 13B:
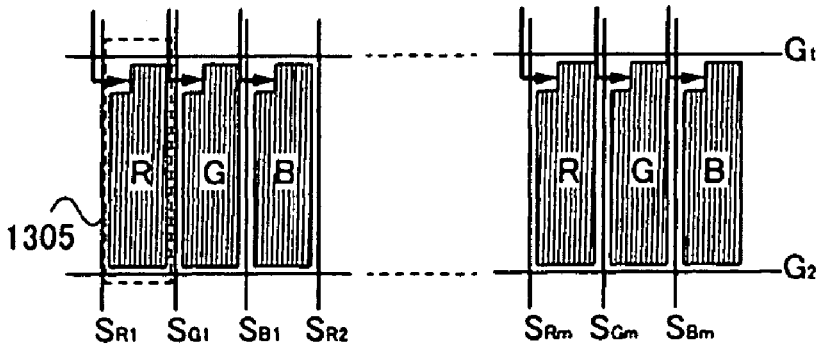

Here, FIGS. 13A and 13B illustrate a structure of a block diagram of a conventional display device for comparison with FIG. 1. FIG. 13A illustrates a structure of a display portion 1301 and a driving portion 1302 as a similar manner to FIG. 1. The driving portion 1302 includes a signal line driver circuit 1303, a scan line driver circuit 1304, and the like. In the display portion 1301, a plurality of pixels 1305 are provided in matrix.

In FIG. 13A, a scan signal is supplied from the scan line driver circuit 1304 to a scan line 1306. In addition, data is supplied from the signal line driver circuit 1303 to a signal line 1308. A scan signal from the scan line 1306 is supplied in such a manner that the pixels 1305 are sequentially selected from a first row of the scan line 1306.

Note that in FIG. 13A, the scan line driver circuit 1304 is connected to n piece of scan lines 1306 which are from $G_1$ to $G_n$. Considering the case where a minimum unit of an image is composed of three pixels of R, G, and B, the signal line driver circuit 1303 is connected to 3m piece of signal lines in total: m piece of signal lines corresponding to R which are from $S_{R1}$ to $S_{Rm}$, m piece of signal lines corresponding to G which are from $S_{G1}$ to $S_{Gm}$, and m piece of signal lines corresponding to B which are from $S_{B1}$ to $S_{Bm}$. That is, as illustrated in FIG. 13B, a signal line is provided to each color element, and data is supplied from the signal line to the pixel corresponding to a color element, so that the pixels 1305 can express a desired color.

As illustrated in FIGS. 13A and 13B, as the resolution of a display device increases, the number of signal lines also increases. However, if the number of signal lines can be reduced, resolution of a display device further increases and low power consumption of a signal line driver circuit can be realized. Hereinafter, an operation of the present invention for display by providing a signal line for each of the color elements is described in detail.

Figure 2:
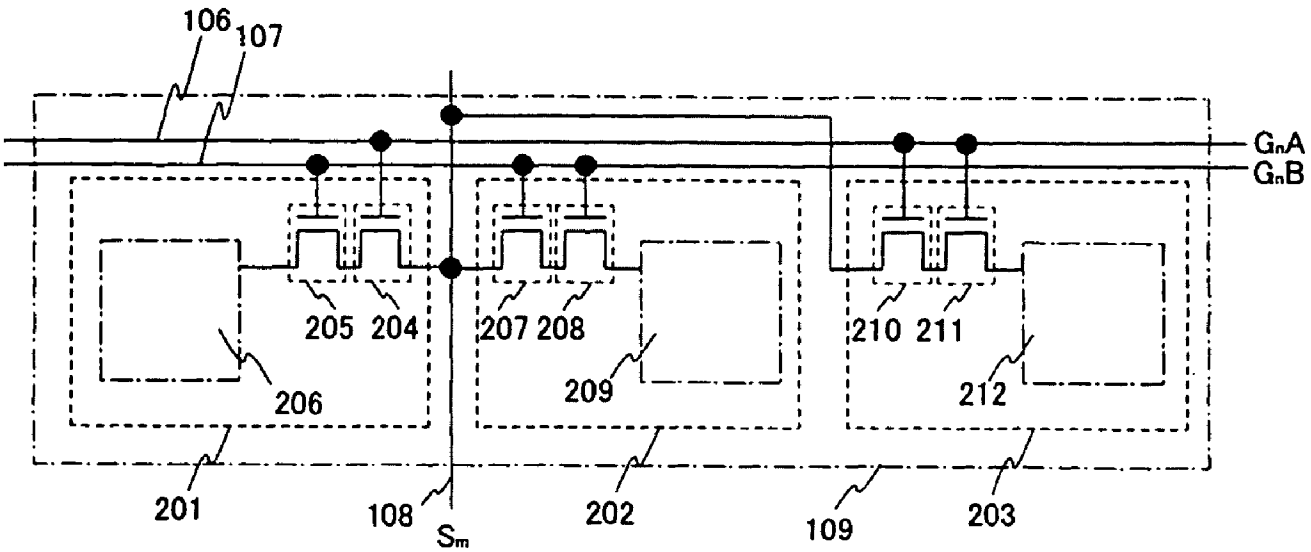
FIG. 2 is a diagram illustrating pixels included in a display device of the present invention.

FIG. 2 illustrates a structure of the pixel group 109 in a display device. A first pixel 201, a second pixel 202, and a third pixel 203 which correspond to color elements of R, G, and B are provided in the pixel group 109. In addition, a first transistor 204, a second transistor 205, and a display element 206 are provided in the first pixel 201. A first transistor 207, a second transistor 208, and a display element 209 are provided in the second pixel 202. A first transistor 210, a second transistor 211, and a display element 212 are provided in the third pixel 203.

Further, in the first pixel 201, a first terminal of the first transistor 204 is connected to the signal line 108; a gate of the first transistor 204 is connected to the first scan line 106; a first terminal of the second transistor 205 is connected to a second terminal of the first transistor 204; a gate of the second transistor 205 is connected to the second scan line 107; and a second terminal of the second transistor 205 is connected to the display element 206.

Furthermore, in the second pixel 202, a first terminal of the first transistor 207 is connected to the signal line 108; a gate of the first transistor 207 is connected to the second scan line 107; a first terminal of the second transistor 208 is connected to a second terminal of the first transistor 207; a gate of the second transistor 208 is connected to the second scan line 107, and a second terminal of the second transistor 208 is connected to the display element 209.

Moreover, in the third pixel 203, a first terminal of the first transistor 210 is connected to the signal line 108; a gate of the first transistor 210 is connected to the first scan line 106; a first terminal of the second transistor 211 is connected to a second terminal of the first transistor 210; a gate of the second transistor 211 is connected to the first scan line 106; and a second terminal of the second transistor 211 is connected to the display element 212.

Note that a transistor is an element having at least three terminals of a gate, a drain, and a source. The transistor includes a channel region between a drain region and a source region, and current can flow through the drain region, the channel region, and the source region. Here, since the source and the drain may change depending on the structure and the operating condition of the transistor, and the like, it is difficult to define which is the source or the drain. Therefore, in this specification, a region functioning as a source or a drain is not called the source or the drain in some cases. In such a case, for example, one of the source and the drain may be called a first terminal and the other terminal may be called a second terminal.

Note that the terms of "first, second, third to N-th (N is a natural number)" are used just to avoid confusion of structural elements and do not mean limitation of the number of the structural elements.

Figure 3A:
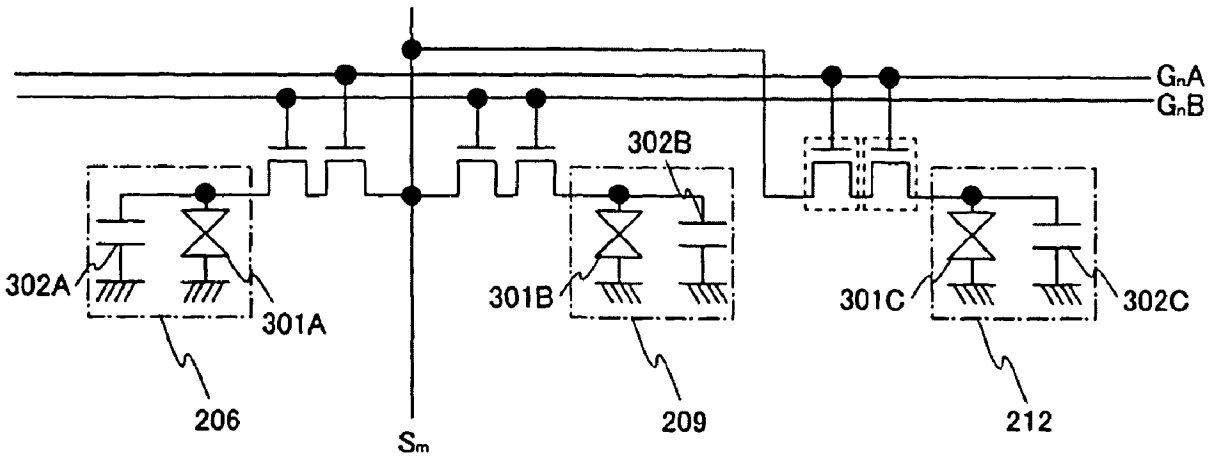
FIGS. 3A and 3B are diagrams illustrating pixels included in a display device of the present invention.
Figure 3B:
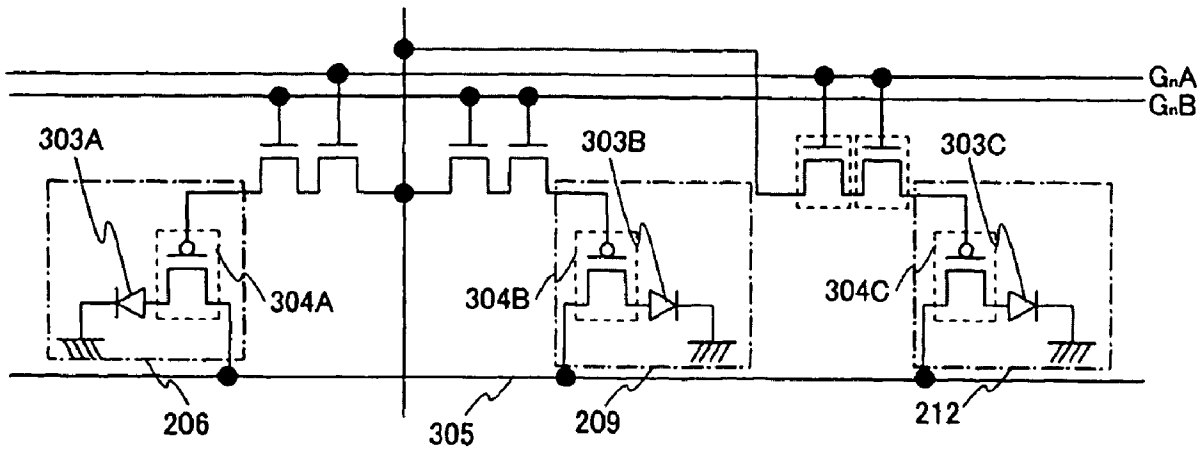

The display element 206, the display element 209, and the display element 212 can include a liquid crystal element or a light emitting element in a circuit illustrated in FIG. 2. As a display element, FIGS. 3A and 3B illustrate a circuit diagram in the case of using a liquid crystal element or a light emitting element. A circuit diagram of FIG. 3A illustrates an example where liquid crystal elements 301A to 301C are used as the display element 206, the display element 209, and the display element 212. Note that it is preferable that the liquid crystal elements 301A to 301C are provided with storage capacitors 302A to 302C, respectively, and each of the liquid crystal elements and the storage capacitor are electrically connected in parallel. In addition, a circuit diagram of FIG. 3B illustrates an example where light emitting elements 303A to 303C are used as display elements. Note that it is preferable that the light emitting elements be connected to a power supply line 305 through transistors 304A to 304C which are used for controlling light emission of light emitting elements and are provided electrically in series. Note that in FIG. 3B, it is preferable that the polarity of the transistors 304A to 304C is determined considering the direction of current flow in the light emitting elements 303A to 303C. For example, in the structure where an anode of a light emitting element and a transistor are connected as illustrated in FIG. 3B, a p-channel transistor is preferable. Note that an EL element including organic and inorganic materials, an organic EL element, or an inorganic EL element can be used as the light emitting element. In this specification, description is made on an assumption that a liquid crystal element is used as a display element.

Note that an electron emitter, electronic ink display, an electrophoresis element, a grating light valve (GLV), a plasma display panel (PDP), a digital micromirror device (DMD), a piezoelectric ceramic display, or the like can be used as the display element 206, the display element 209, and the display element 212.

Note that various types of transistors can be used as the first transistor 210 and the second transistor 211. Therefore, there is no limitation to the kinds of transistors to be used. For example, a thin film transistor (TFT) including amorphous silicon, polycrystalline silicon, microcrystalline (also referred to as semi-amorphous) silicon, single crystal silicon, or the like can be used. Alternatively, a transistor including a compound semiconductor or an oxide semiconductor such as ZnO, a-InGaZnO, SiGe, GaAs, and furthermore, a thin film transistor obtained by thinning such the compound semiconductor or the oxide semiconductor can be used. Thus, manufacturing temperature can be decreased and for example, a transistor can be formed at room temperature.

Figure 4A:
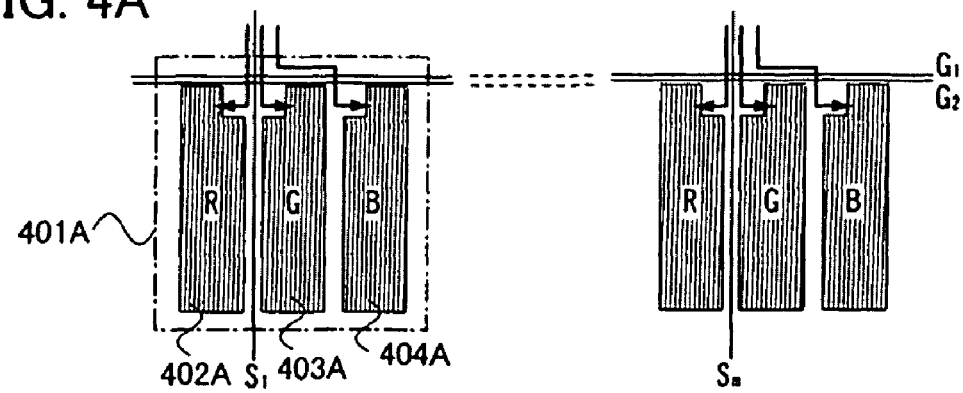
FIGS. 4A to 4C are diagrams illustrating pixels included in a display device of the present invention.
Figure 4B:
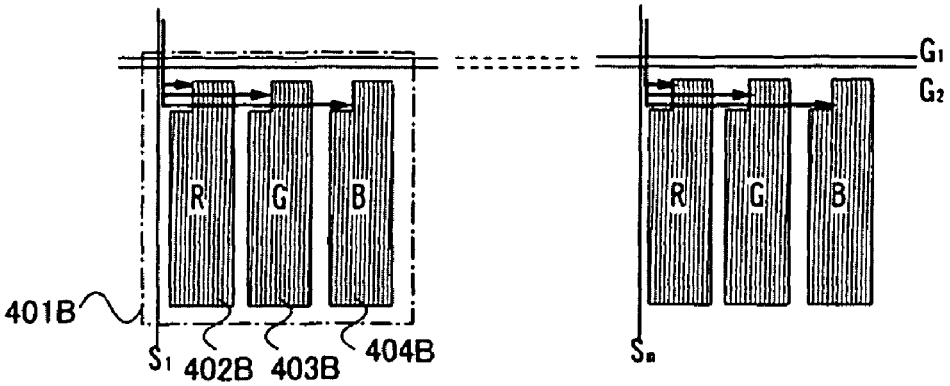
Figure 4C:
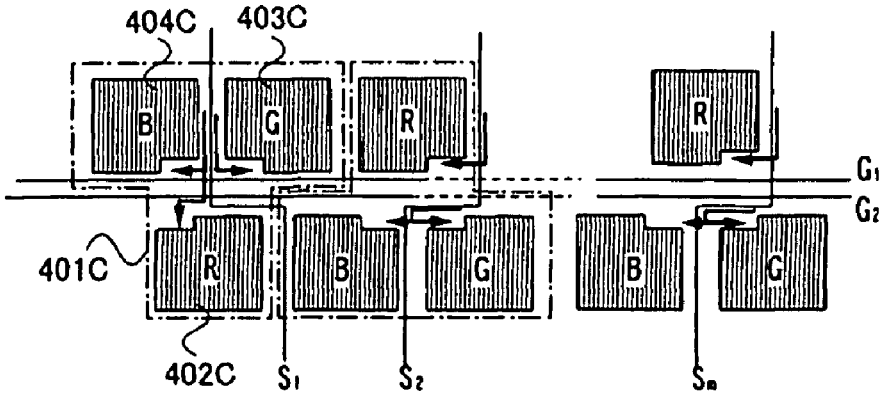

Note that in the pixel group 109 illustrated in FIG. 2, the signal line 108 is provided between the pixels of R, G, and B which are provided in matrix; however, the present invention is not limited to this structure. FIGS. 4A to 4C illustrate arrangement examples of signal lines and pixels which correspond to one of color elements of R, G, and B in one pixel group. FIGS. 4A to 4C are schematic views in which R pixels 402A to 402C, G pixels 403A to 403C, and B pixels 404A to 404C are included in pixel groups 401A to 401C respectively, and the pixel groups 401A to 401C are controlled by a signal line $S_1$, and a first scan line $G_1$ and a second scan line $G_2$. As illustrated in FIG. 4A, the signal line $S_1$ may be provided between the pixel 402A and the pixel 403A which are provided in stripe arrangement in the pixel group 401A. By employing the structure illustrated in FIG. 4A, data in the signal line can be input to a display element in the pixel without being transferred through the lead wiring. In addition, as illustrated in FIG. 4B, the signal line $S_1$ may be provided outside the pixel group 401B. It is preferable to employ the structure illustrated in FIG. 4B because a layout for designing a circuit can be easily performed. Further, as illustrated in FIG. 4C, the pixels may be provided in a delta arrangement, and the signal line $S_1$ may be provided meanderingly so as to thread between the pixel 402C, the pixel 403C, and the pixel 404C. The structure illustrated in FIG. 4C can give an impression on human eyes that an image of nature or the like including many curves is particularly smooth.

Next, a driving method of the pixels corresponding to R, G, and B in the pixel group 109, which is a minimum unit of an image and is illustrated in FIG. 2, is described.

Figure 5:
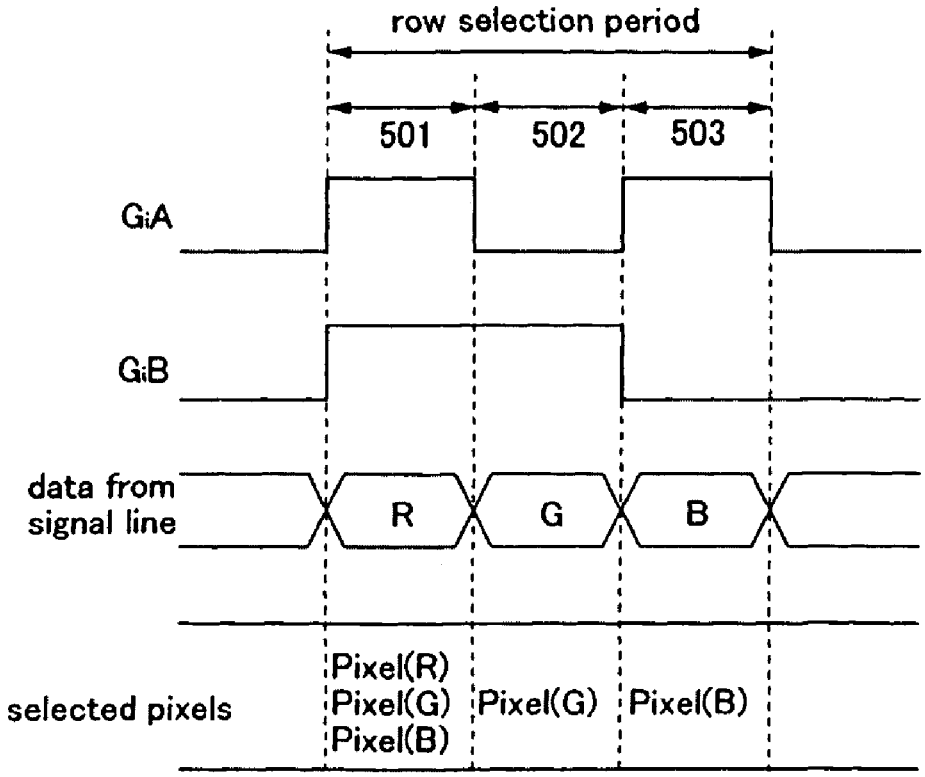
FIG. 5 is a timing chart for illustrating the present invention.

A timing chart of FIG. 5 illustrates the timing of a pixel selected by a scan signal of the first scan line 106 ($G_iA$), a scan signal of the second scan line 107 ($G_iB$), data of the signal line, and a scan signal in a row selection period (time for scanning one row of pixels of a display device) in FIG. 2.

Note that a circuit diagram of FIG. 2 illustrates the case where n-channel transistors are used as the first transistor and the second transistor. Then, description of FIG. 5 is also used for description of driving the pixel in the case where the on or off of the n-channel transistor is controlled. Note that when a p-channel transistor is used in the circuit diagram in FIG. 2, the potential of a scan signal may be changed appropriately so that operation of turning on or off of transistor can be the same.

In the timing chart of FIG. 5, it is assumed that one frame period, which corresponds to a period to display an image for one screen, is set to be at least 1/60 second so that a person who watches the image does not sense flickers, and the number of scan lines is M, and thus, a row selection period corresponds to 1/60M second. For example, in the case of a display device having resolution of video graphics array (VGA: 640×480) and not taking into consideration delay of a signal due to a wiring, or the like, a row selection period is equivalent to 1/28800 second (≈34.72 μs).

The driving method of the pixel of this embodiment mode which is illustrated in the timing chart of FIG. 5 is as follows: in the row selection period, the scan signals of the first scan line and the second scan line are divided into some periods according to the number of R, G, and B pixels and the first scan line and the second scan line are controlled. Next, the order of writing in pixels which are controlled by the signals from the first scan line and the second scan line is described. Note that the selection timing of the first scan line $G_iA$ connected to a pixel in i-th row and the second scan line $G_iB$ connected to the pixel in i-th row is illustrated.

First, in a first period 501 illustrated in FIG. 5, a scan signal of the first scan line $G_iA$ and a scan signal of the second scan line $G_iB$ are set to have high potential, so that the first transistor and the second transistor in the first pixel, the first transistor and the second transistor in the second pixel, and the first transistor and the second transistor in the third pixel come to an on state. At that time, the first to the third pixels are selected, and the data in the signal line is supplied to each display element. At this time, data which should be supplied to the display element in the first pixel from the signal line is supplied to the display elements in the second pixel and the third pixel.

Note that "the on state" of a transistor in this specification represents the state that a first terminal and a second terminal of the transistor are brought into conduction. Further, "the off state" of a transistor in this specification represents the state that a first terminal and a second terminal of the transistor are brought out of conduction.

Next, in a second period 502 illustrated in FIG. 5, a scan signal of the first scan line is set to have low potential and a scan signal of the second scan line is set to have high potential, so that the first transistor comes to an on state and the second transistor comes to off state in the first pixel; the first transistor and the second transistor in the second pixel come to an on state; and the first transistor and the second transistor in the third pixel come to an off state. At that time, the data in the signal line is not supplied to the display elements in the first pixel and the third pixel, but is supplied only to the display element in the second pixel.

Next, in a third period 503 illustrated in FIG. 5, a scan signal of the first scan line is set to have high potential and a scan signal of the second scan line is set to have low potential, so that the first transistor comes to an off state and the second transistor comes to an on state in the first pixel; the first transistor and the second transistor in the second pixel come to an off state; and the first transistor and the second transistor in the third pixel come to an on state. At that time, the data in the signal line is not supplied to the display elements in the first pixel and the second pixel, but is supplied only to the display element in the third pixel.

In the driving method of a pixel in a display device which is described in this embodiment mode, data of R, which is one of the color elements, is input to the display elements of the first to the third pixels in the first period as described above. However, in the present invention, since a row selection period is divided by each of color elements of R, G, and B and scanning is performed, the period in which data of R is input to the second pixel and the third pixel is equal to or less than 1/180M second. Therefore, even when the data of R is input to the pixels corresponding to the color elements of B and G, operation can be conducted without influence on image display. For example, in the case of a display device having resolution of video graphics array (VGA: 640×480) and not taking into consideration of delay of a signal due to a wiring, or the like, a row selection period is equivalent to 1/86400 second (≈11.57 μs) which is a period in which R data is input to pixels corresponding to color elements of B and G, For example, in the case where the display element is a liquid crystal element, it takes at least a few ms for the liquid crystal element to optically respond. Therefore, even when data of R is input to the pixels corresponding to the color elements of B and G, operation can be conducted without an influence on image display.

Note that in the case where the display element is a liquid crystal element, data of R is input to the display element of the pixels corresponding to the color elements of B and G in advance, so that inclination of a liquid crystal molecule can be obtained by voltage application. Therefore, it is preferable to adopt the present driving method because, when data of G which is input next to R is input to a display element provided with a liquid crystal molecule of the pixel corresponding to G, desired alignment of liquid crystal can be obtained in a short time.

Figure 6:
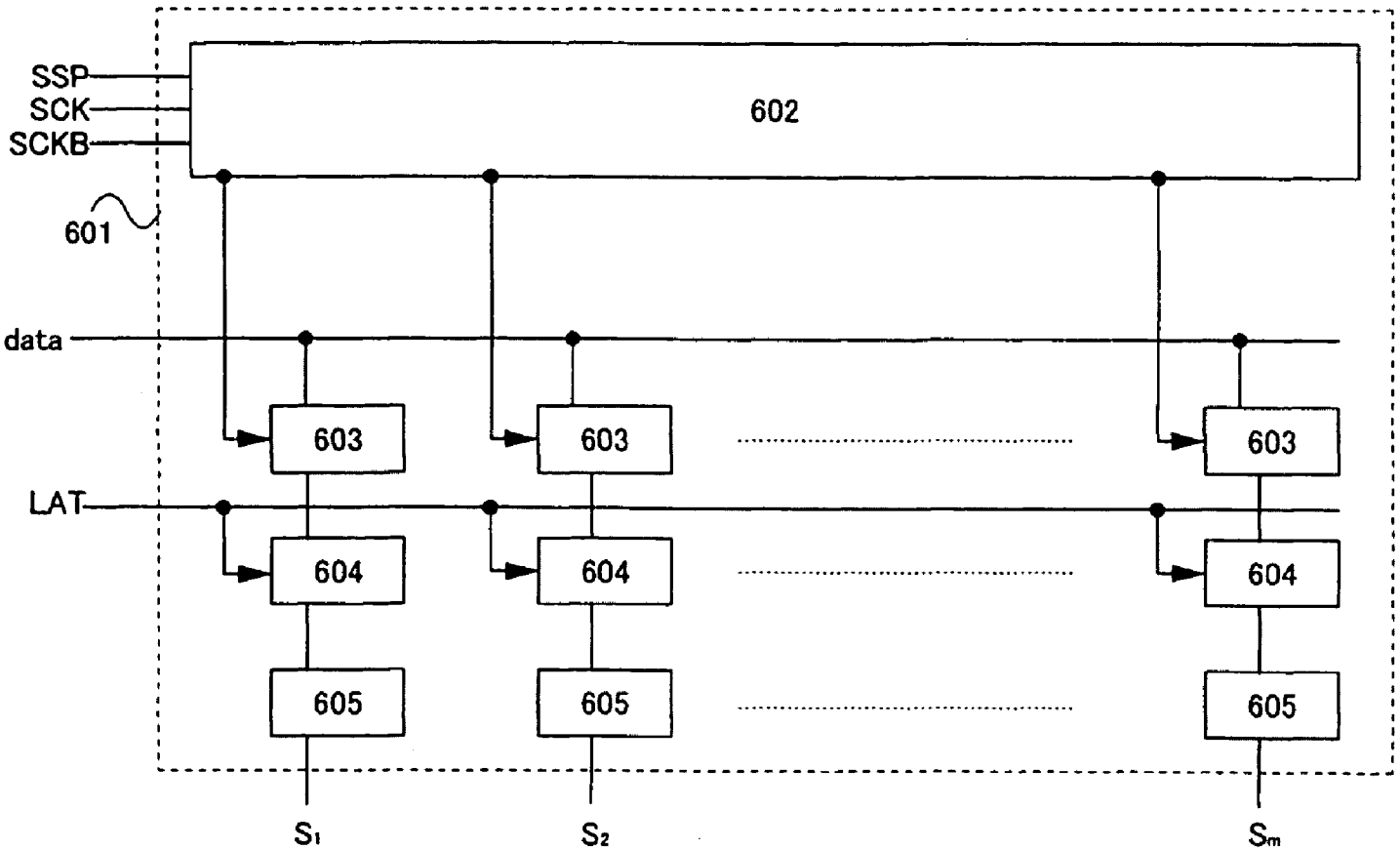
FIG. 6 is a diagram illustrating a structure of a signal line driver circuit.

Next, advantages of the display device provided with a pixel structure of the present invention are described with reference to a structure of a signal line driver circuit (also referred to as a source driver). FIG. 6 is a block diagram of a signal line driver circuit. Note that the structure of the signal line driver circuit illustrated in FIG. 6 is an example for driving pixels of the display device with line sequential driving, and in which a liquid crystal display element is used as a display element.

A signal line driver circuit 601 in FIG. 6 includes a shift register 602, first latch circuits 603, second latch circuits 604, and D/A conversion circuits 605.

A source driver start pulse (SSP), a source driver clock signal (SCK), an inverted source driver clock signal (SCKB), or the like is supplied to the shift register 602. The shift register 602 selects the first latch circuits 603 one by one. Note that a level shifter circuit may be provided between the shift register 602 and the first latch circuit 603.

An input terminal of the first latch circuit 603 is connected to an output terminal of the shift register 602 and a wiring from which image data is input. An output terminal of the first latch circuit 603 is connected to the second latch circuit 604.

The second latch circuit 604 is used for storing image data which is input to the first latch circuit 603 and is connected to a wiring from which a signal for controlling the second latch circuit 604 is input. An output terminal of the second latch circuit 604 is connected to the D/A conversion circuit 605.

The D/A conversion circuit 605 is a circuit which converts digital image data, which is output simultaneously based on a signal for controlling the second latch circuit 604, to analog data. Each output terminal of the D/A conversion circuits 605 is connected to signal lines $S_1$ to $S_m$.

In the present invention, the number of signal lines connected to pixels can be reduced. Therefore, in the structure of the signal line driver circuit illustrated in FIG. 6, the number of output wirings from the shift register 602 is reduced, and the number of the first latch circuits 603, the second latch circuits 604, and the D/A conversion circuits 605 can be reduced. In other words, in a display device of the present invention, the number of the signal lines can be reduced to one-third, whereby cost for the shift register 602, the first latch circuits 603, the second latch circuits 604, and the D/A conversion circuits 605 can be reduced. In particular, since it is necessary for the D/A conversion circuits 605 to raise the voltage which is output to a pixel for driving a liquid crystal display element, the D/A conversion circuit readily generates heat. However, by reduction in the number of D/A conversion circuits, low power consumption can be realized, and thus, the generation of heat can be neglected.

Figure 7:
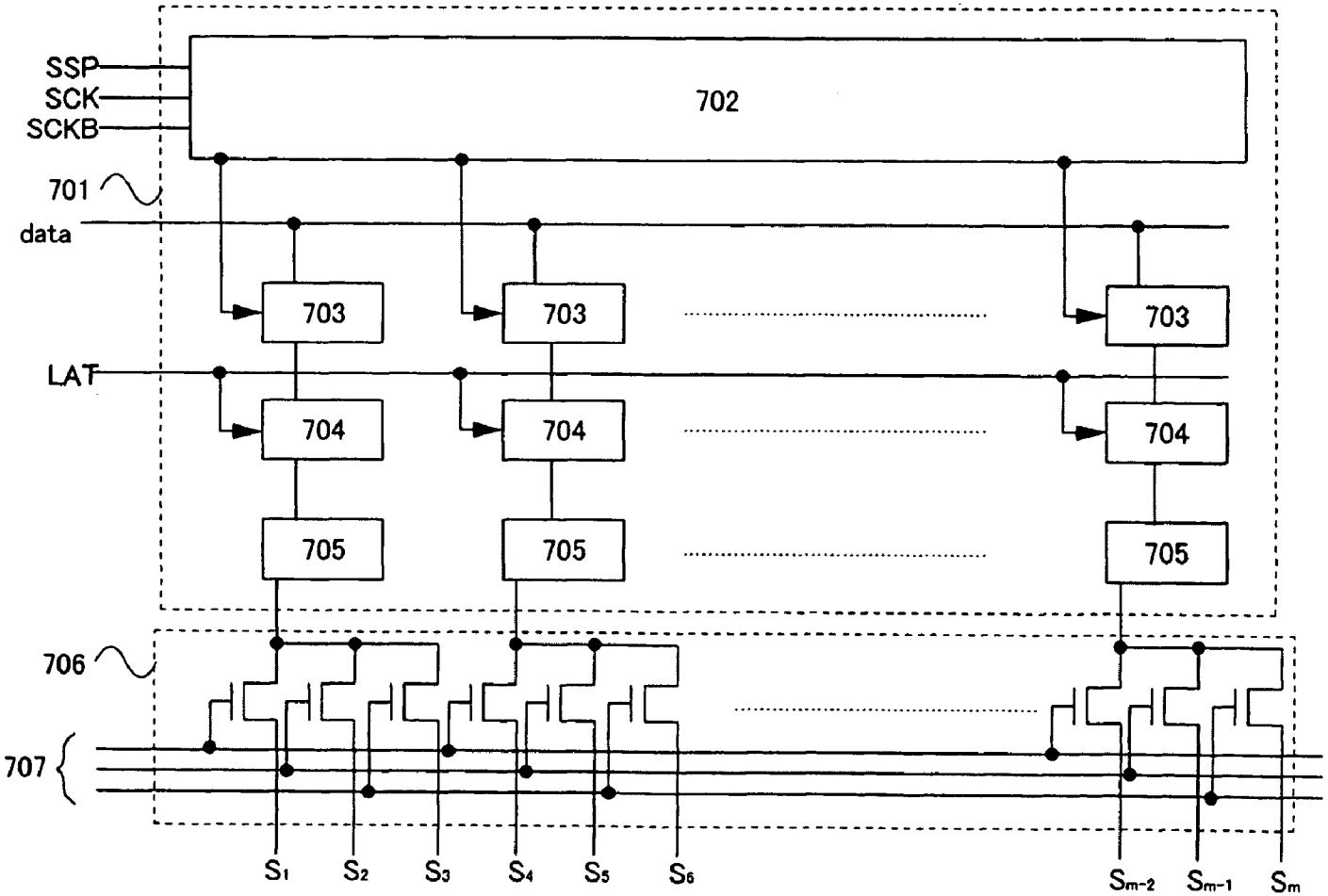
FIG. 7 is a diagram illustrating a structure of a signal line driver circuit.

Moreover, FIG. 7 illustrates a structure which is different from the block diagram of the signal line driver circuit illustrated in FIG. 6. Note that the structure of a signal line driver circuit illustrated in FIG. 7 is an example for driving pixels of a display device with line sequential driving, and in which a liquid crystal display element is used as a display element.

FIG. 7 illustrates a signal line driver circuit 701 including a shift register 702, first latch circuits 703, second latch circuits 704, and D/A conversion circuits 705, and a signal selection circuit 706 having wirings 707.

A source driver start pulse (SSP), a source driver clock signal (SCK), an inverted source driver clock signal (SCKB), or the like is supplied to the shift register 702. The shift register 702 selects the first latch circuits 703 one by one. Note that a level shifter circuit may be provided between the shift register 702 and the first latch circuit 703.

An input terminal of the first latch circuit 703 is connected to an output terminal of the shift register 702 and a wiring from which image data is input. An output terminal of the first latch circuit 703 is connected to the second latch circuit 704.

The second latch circuit 704 is used for storing image data which is input to the first latch circuit 703 and is connected to a wiring from which a signal for controlling the second latch circuit 704 is input. An output terminal of the second latch circuit 704 is connected to the D/A conversion circuit 705.

The D/A conversion circuit 705 is a circuit which converts digital image data, which is output simultaneously based on a signal for controlling the second latch circuit 704, to analog data. Each output terminal of the D/A conversion circuits 705 is connected to a first terminal of a transistor included in the signal selection circuit 706, and the number of transistors corresponds to the number of signal lines $S_1$ to $S_m$.

The signal selection circuit 706 is a circuit which selects image data output from the D/A conversion circuit and distributes and output the selected image data to signal lines. As a specific example, in the signal selection circuit 706, a plurality of transistors may be provided as switches. The number of the transistors corresponds to the number of signal lines $S_1$ to $S_m$, and on or off of the transistors may be selected sequentially by the wirings 707 connected to gates of the transistors. Then, the signal selection circuit 706 selects a signal line connected to a second terminal of the transistors, and image data which is output from the D/A conversion circuit is output.

The wirings 707 are wirings which sequentially select the transistors included in the signal selection circuit 706 and output a signal for controlling on or off state. A signal for sequentially selecting the transistors may be supplied from the scan line driver circuit through the wiring 707.

In the present invention, the number of signal lines connected to pixels can be reduced. Further, in the structure of the signal line driver circuit illustrated in FIG. 7, image data can be distributed to the signal lines by the signal selection circuit 706 which is provided between the D/A conversion circuits 705 and the signal lines. Therefore, in the structure of the signal line driver circuit illustrated in FIG. 7, the number of the output wirings from the shift register 702 can be further reduced, and the number of the first latch circuits 703, the second latch circuits 704, and the D/A conversion circuits 705 can be further reduced, compared to those in the structure of the signal line driver circuit illustrated in FIG. 6. In other words, in a display device of the present invention, the number of signal lines can be reduced to one-third, and image data can be distributed into three signal lines by the signal selection circuit, so that cost of the shift register 702, the first latch circuits 703, the second latch circuits 704, and the D/A conversion circuits 705 can be reduced. In particular, since it is necessary for the D/A conversion circuits 705 to raise the voltage which is output to a pixel for driving the liquid crystal display element, the D/A conversion circuit readily generates heat. However, by reduction in number of the D/A conversion circuits, low power consumption can be realized, which allows the heat generation to be neglected.

This embodiment mode can be arbitrarily combined with another embodiment mode.

(Embodiment Mode 2)

In this embodiment mode, a structure of a top view and a cross-sectional view of a pixel in the display device of the present invention which is described in the above embodiment mode is described.

Figure 8A:
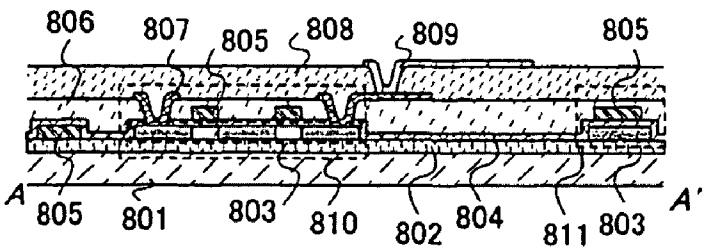
FIGS. 8A and 8B are diagrams illustrating pixels included in a display device of the present invention.
Figure 8B:
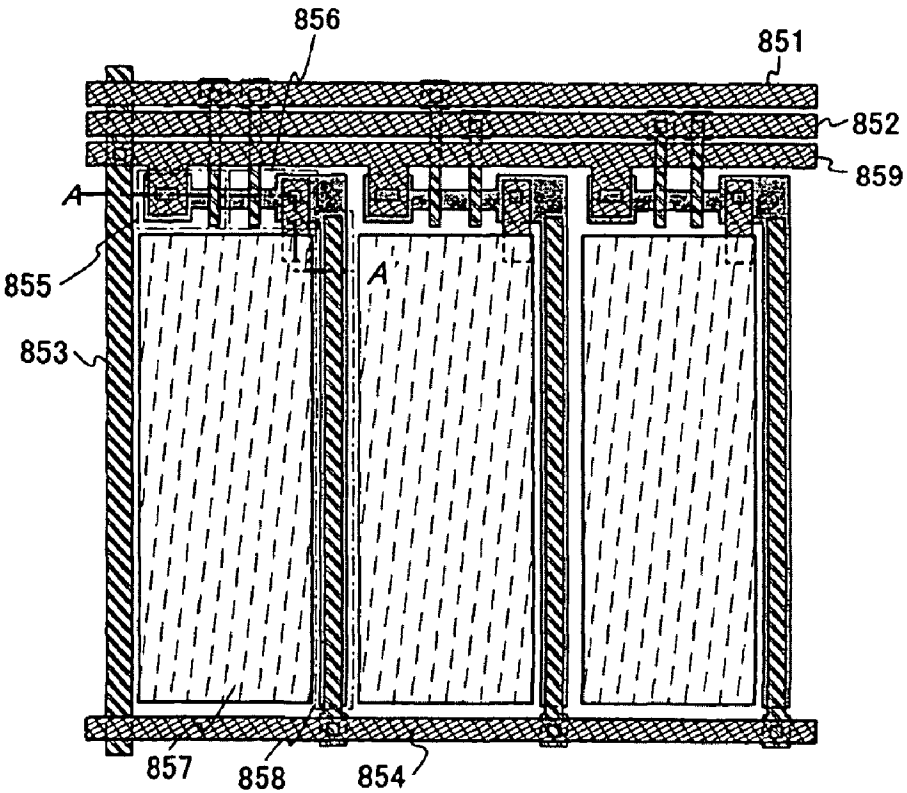

FIGS. 8A and 8B are a cross-sectional view and a top view of a pixel, in the case where thin film transistors (TFT) are used as the first transistor and the second transistor which are described in the above embodiment mode. FIG. 8A is a cross-sectional view of the pixel, and FIG. 8B is a top view of the pixel. Further, the cross-sectional view of the pixel illustrated in FIG. 8A corresponds to line A-A' in the top view of the pixel illustrated in FIG. 8B.

Note that the TFT illustrated in FIG. 8A is a top gate TFT using an amorphous semiconductor or a polycrystalline semiconductor. However, the present invention is not limited thereto. As the structure of the TFT, a bottom gate TFT may be used. When the top gate TFT is manufactured, the TFT using an amorphous semiconductor is used. By using an amorphous semiconductor, there is an advantage in that the TFT can be manufactured using a large area substrate at low cost.

Next, the structure of a cross-sectional view illustrated in FIG. 8A is described. In this embodiment mode, in particular, a method for manufacturing an element over a substrate on the TFT-formed side is described.

First, a first insulating film 802 is formed over a substrate 801. The first insulating film 802 may be an insulating film such as a silicon oxide film, a silicon nitride film, or a silicon oxynitride film ($SiO_xN_y$). Alternatively, an insulating film having a stacked structure in which at least two of these films are combined may be used. When the present invention is implemented by forming the first insulating film 802, change in characteristics of the TFT due to an impurity from the substrate which affects a semiconductor layer can be prevented; therefore, a display device with high reliability can be obtained. Note that in the case where the present invention is implemented without forming the first insulating film 802, since the number of steps can be reduced, the manufacturing cost can be reduced. In addition, since the structure is simple, the yield can be improved.

Note that a substrate having light-transmitting properties is preferably used as the substrate 801. For example, a quartz substrate, a glass substrate, or a plastic substrate may be used. Note that the substrate 801 may be a light-shielding substrate such as a semiconductor substrate or a silicon on insulator (SOI) substrate.

Next, a semiconductor film 803 is formed on the first insulating film 802, and the shape of the semiconductor film 803 is processed by a method such as a photolithography method. Note that as a material used for the semiconductor film 803, silicon, silicon germanium (SiGe), or the like is preferable.

Next, a second insulating film 804 is formed. At this time, a film formation apparatus such as a sputtering apparatus or a CVD apparatus may be used. Note that as a material used for the second insulating film 804, a thermal oxidation film, a silicon oxide film, a silicon nitride film, a silicon oxynitride film, or the like is preferable. Alternatively, a stacked structure of these films may be used.

Next a first conductive film 805 is formed over the semiconductor film 803 and the first insulating film 802 with the second insulating film 804 interposed therebetween. Note that the first conductive film 805 may also be formed by processing the shape using a photolithography method or the like. Note that as a material used for the first conductive film 805, Mo, Ti, Al, Nd, Cr, or the like is preferable. Alternatively, a stacked structure of them may be used. Further alternatively, the first conductive film 805 may be formed as a single layer or a stacked structure of an alloy of these elements. Note that an impurity element imparting conductivity is introduced to the semiconductor film 803 using the first conductive film 805 as a mask.

Subsequently, a third insulating film 806 is formed. Note that as a material used for the third insulating film 806, an inorganic material (silicon oxide, silicon nitride, silicon oxynitride, or the like) is preferred. Note that the third insulating film 806 may also be formed by processing the shape. A method for processing the shapes is preferably a method such as photolithography, which is described above. At the processing of the third insulating film 806 by etching, a contact hole that allows the semiconductor film 803 to be exposed can be simultaneously formed.

Subsequently, a second conductive film 807 is formed. It is preferable that a sputtering method or a printing method be used at this time. Note that a material used for the second conductive film 807 may have light-transmitting properties or reflective properties. Note that a material used for the second conductive film 807 may be similar to that of the first conductive film 805. Further, the second conductive film 807 may be formed by processing the shape.

Subsequently, a fourth insulating film 808 is formed. Note that as a material used for the fourth insulating film 808, an inorganic material (silicon oxide, silicon nitride, silicon oxynitride, or the like), an organic material, or the like is preferable. Note that the fourth insulating film 808 may be formed by processing the shape. A method for processing the shape is preferably a method such as photolithography, which is described above. At this time, a contact hole that allows the second conductive film 807 to be exposed can be formed. Note that the surface of the fourth insulating film 808 is preferably as even as possible.

Subsequently, a third conductive film 809 is formed. It is preferable that a sputtering method or a printing method be used at this time. Note that a material used for the third conductive film 809 may have light-transmitting properties or reflective properties, similarly to the second conductive film 807. Note that a material which can be used for the third conductive film 809 may be similar to that of the second conductive film 807. In addition, the third conductive film 809 may be formed by processing the shape. As a method for processing the shape, the same method as that of the second conductive film 807 may be used. Note that the third conductive film 809 may have a function as a pixel electrode for electrically connecting to a display element.

Note that a transistor 810 and a capacitor element 811 are formed over the substrate 801 through the above steps, and a wiring for driving the transistor is formed at the same time.

Subsequently, an example of a layout of a pixel of a display device is described with reference to FIG. 8B. Note that FIG. 8B illustrates a structure in which the first to the third pixels which are described in the first embodiment mode are arranged. Note that the difference between the first to third pixels is that connection between the first and the second scan lines, and first and the second transistors is different, as described in the first embodiment mode. Therefore, here, the description focuses on any one of the first to the third pixels.

The pixel which can be applied to a display device of the present invention illustrated in FIG. 8B includes a first scan line 851, a second scan line 852, a signal line 853, a capacitor line 854, a first transistor 855, a second transistor 856, a pixel electrode 857, and a capacitor element 858, as an example. A wiring 859 illustrated in FIG. 8B is a wiring provided for supplying image data to a first terminal of the first transistor 855 in the first to the third pixels from the signal line 853.

The first scan line 851 and the second scan line 852 are electrically connected to gates of the first transistor 855 and the second transistor 856. At this time, it is preferable that the first scan line 851 and the second scan line 852 are electrically connected to the first transistor 855 and the second transistor 856 by another wiring which is connected through a contact hole. In other words, the layer of the second conductive film 807 described in FIG. 8A is equivalent to that of the first scan line 851 and the second scan line 852, and the layer of the first conductive film 805 is equivalent to that of another wiring which is connected through a contact hole.

Since the signal line 853 is electrically connected to the first terminal of the first transistor 855, the signal line 853 is preferably connected to the wiring 859 through a contact hole. Note that since the layer of the signal line 853 is formed using different layer from the layer of the first scan line 851 and the second scan line 852, it is preferable that the signal line 853 is formed using the same layer as that of the first conductive film 805 which is described in FIG. 8A.

The capacitor line 854 is formed using the same layer as that of the second conductive film 807 described in FIG. 8A and is electrically connected to the first conductive film 805 through a contact hole. In addition, the first conductive film 805 which is electrically connected to the capacitor line 854 is overlaps with a region which is extended from the semiconductor film 803 to which conductivity is imparted and which is included in the first transistor 855 and the second transistor 856. In other words, a capacitor element can be formed in a region where the first conductive film 805 overlaps with the semiconductor film 803 to which conductivity is imparted with the second insulating film 804 interposed therebetween.

In the present invention, the number of signal lines connected to pixels can be reduced. Therefore, an area of a display region which is connected to a transistor in the pixel can be increased. On the other hand, it is conceivable that display elements are provided closely between adjacent pixels in a portion without a signal line. However, it is preferable to employ this embodiment mode in such a case because the ability of this embodiment mode to allow the formation of a capacitor element by extending the wiring in the portion where pixels are adjacent without the signal line can prevent crosstalk between display elements in the adjacent pixels.

This embodiment mode can also be arbitrarily combined with another embodiment mode.

(Embodiment Mode 3)

Figure 9A:
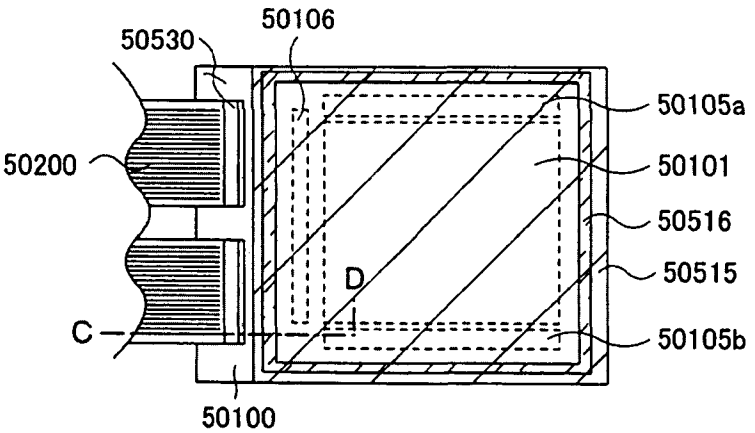
FIGS. 9A and 9B are diagrams illustrating a display device of the present invention.
Figure 9B:
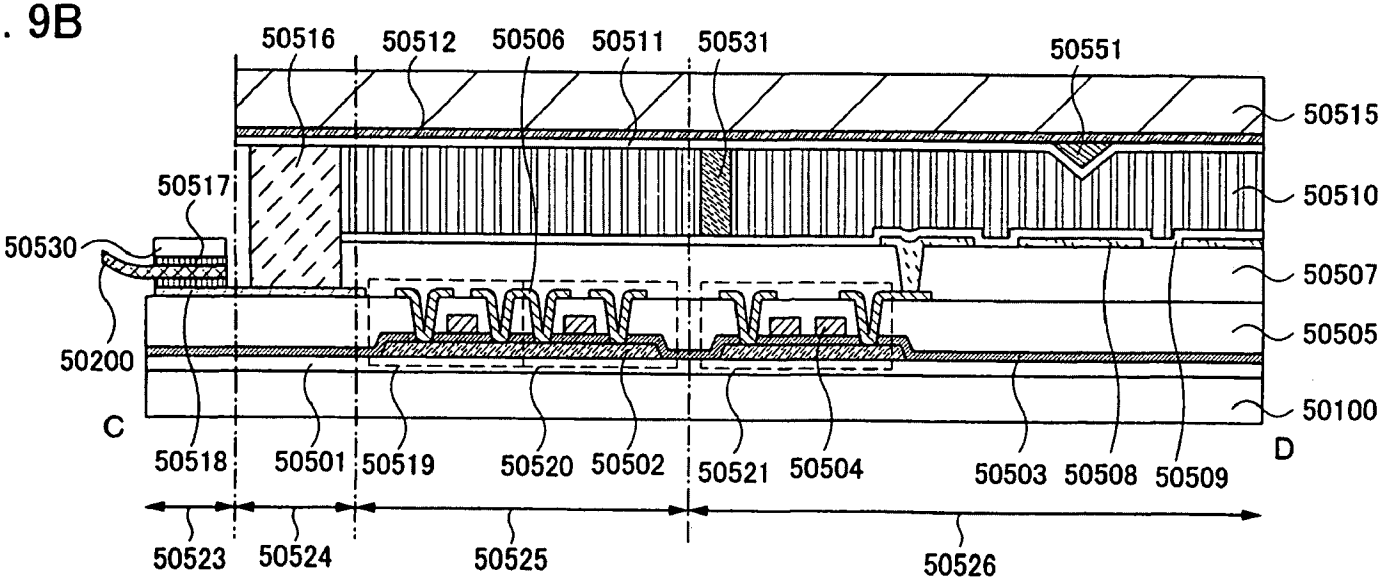

In this embodiment mode, a structure of a display portion of a display device of the present invention is described with reference to FIGS. 9A and 9B. Specifically, a liquid crystal display element is used as a display element, and a structure of a display device including a TFT substrate, a counter substrate, and a liquid crystal layer interposed between the counter substrate and the TFT substrate is described. FIG. 9A is a top view of the display device. FIG. 9B is a cross-sectional view taken along line C-D of FIG. 9A. Note that FIG. 9B is a cross-sectional view of a top gate transistor in a case where a crystalline semiconductor film (polysilicon film) is formed as a semiconductor film over a substrate 50100 and a display mode is a multi-domain vertical alignment (MVA) mode.

The liquid crystal panel illustrated in FIG. 9A includes, over the substrate 50100, a pixel portion 50101, a first scan line driver circuit 50105*a*, a second scan line driver circuit 50105*b*, and a signal line driver circuit 50106. The pixel portion 50101, the first scan line driver circuit 50105*a*, the second scan line driver circuit 50105*b*, and the signal line driver circuit 50106 are sealed between the substrate 50100 and a substrate 50515 with a sealant 50516. In addition, an FPC 50200 and an IC chip 50530 are provided over the substrate 50100 by a TAB method.

Note that circuits similar to those described in Embodiment Mode 1 can be used as the first scan line driver circuit 50105*a*, the second scan line driver circuit 50105*b*, and the signal line driver circuit 50106.

A cross-sectional structure taken along line C-D of FIG. 9A is described with reference to FIG. 9B. Over the substrate 50100, the pixel portion 50101 and a peripheral driver circuit portion thereof (the first scan line driver circuit 50105*a*, the second scan line driver circuit 50105*b*, and the signal line driver circuit 50106) are formed. Here, a driver circuit region 50525 (the second scan line driver circuit 50105*b*) and a pixel region 50526 (the pixel portion 50101) are shown.

First, an insulating film 50501 is formed over the substrate 50100 as a base film. As the insulating film 50501, a single layer of an insulating film such as a silicon oxide film, a silicon nitride film, or a silicon oxynitride film ($SiO_xN_y$), or a stacked layer including at least two of these films is used. Note that a silicon oxide film is preferably used for a portion in contact with a semiconductor. Accordingly, an electron trap in the base film or hysteresis in transistor characteristics can be suppressed. Further, at least one film containing a large component of nitrogen is preferably provided as the base film. By this film, contamination by impurities from glass can be suppressed.

Next, a semiconductor film 50502 is formed over the insulating film 50501 by a photolithography method, an inkjet method, a printing method, or the like.

Next, an insulating film 50503 is formed over the semiconductor film 50502 as a gate insulating film. Note that as the insulating film 50503, a single layer structure or a stacked structure of a film formed by thermal oxidation of the semiconductor film 50502, a silicon oxide film, a silicon nitride film, a silicon oxynitride film, or the like can be used. A silicon oxide film is preferably used for the insulating film 50503 which is in contact with the semiconductor film 50502. This is because population of a trap level at an interface between the insulating film 50503 and the semiconductor film 50502 can be decreased with use of a silicon oxide film. Further, when a gate electrode is formed using Mo, a silicon nitride film is preferably used for the gate insulating film which is in contact with the gate electrode. This is because Mo is not oxidized by a silicon nitride film. Here, as the insulating film 50503, a silicon oxynitride film (composition ratio: Si=32%, O=59%, N=7%, and H=2%) having a thickness of 115 nm is formed by a plasma CVD method.

Next, a conductive film 50504 is formed over the insulating film 50503 as a gate electrode by a photolithography method, an inkjet method, a printing method, or the like. Note that as the conductive film 50504, Ti, Mo, Ta, Cr, W, Al, Nd, Cu, Ag, Au, Pt, Nb, Si, Zn, Fe, Ba, Ge, or the like, an alloy of these elements, or the like is used. Alternatively, a stacked layer of these elements or alloys thereof may be used. Here, the gate electrode is formed using Mo. Mo is preferable because it can be easily etched and is resistant to heat. Note that the semiconductor film 50502 is doped with an impurity element using the conductive film 50504 or a resist as a mask in order to form a channel formation region and impurity regions to be a source region and a drain region. Note that the impurity concentration in the impurity region may be controlled to form a high-concentration impurity region and a low-concentration impurity region. The conductive film 50504 in a transistor 50521 is formed to have a dual-gate structure. When the transistor 50521 has a dual-gate structure, off-current of the transistor 50521 can be reduced. The dual-gate structure has two gate electrodes. Note that a plurality of gate electrodes may also be provided over a channel formation region in a transistor. Alternatively, the conductive film 50504 in the transistor 50521 may have a single gate structure. Further, a transistor 50519 and a transistor 50520 can be manufactured in the same process as the transistor 50521.

Next, as an interlayer film, an insulating film 50505 is formed over the insulating film 50503 and the conductive film 50504 formed over the insulating film 50503. As the insulating film 50505, an organic material, an inorganic material, or a stacked structure thereof can be used. For example, the insulating film 50505 can be formed using a material such as silicon oxide, silicon nitride, silicon oxynitride, silicon nitride oxide, aluminum nitride, aluminum oxynitride, aluminum nitride oxide containing higher composition of nitrogen than that of oxygen, aluminum oxide, diamond like carbon (DLC), polysilazane, nitrogen-containing carbon (CN), PSG (phosphosilicate glass), BPSG (borophosphosilicate glass), alumina, or other substances containing an inorganic insulating material. Alternatively, an organic insulating material may also be used. The organic material may be either photosensitive or nonphotosensitive, and polyimide, acrylic, polyamide, polyimideamide, benzocyclobutene-based polymer, a siloxane resin, or the like can be used. Note that the siloxane resin corresponds to a resin including a Si—O—Si bond. Siloxane has a skeleton structure of a bond of silicon (Si) and oxygen (O). As for a substituent, an organic group such as an alkyl group or aromatic hydrocarbon is used. As for a substituent, a fluoro group may be used. Further, as for a substituent, a fluoro group and an organic group may be used. Note that contact holes are selectively formed in the insulating film 50503 and the insulating film 50505. For example, a contact hole is formed on the upper surface of the impurity region of each transistor.

Next, over the insulating film 50505, conductive films 50506 are formed as a drain electrode, a source electrode, and a wiring by a photolithography method, an inkjet method, a printing method, or the like. Note that as a material of the conductive film 50506, Ti, Mo, Ta, Cr, W, Al, Nd, Cu, Ag, Au, Pt, Nb, Si, Zn, Fe, Ba, Ge, or the like, an alloy of these elements, or the like is used. Alternatively, a stacked structure of these elements or alloys thereof may be used. Further, in a portion where contact holes are formed in the insulating film 50503 and the insulating film 50505, the conductive film 50506 is connected to the impurity region of the semiconductor film 50502 of the transistor.

An insulating film 50507 is formed as a planarizing film over the insulating film 50505 and the conductive film 50506 formed over the insulating film 50505. Note that the insulating film 50507 preferably has high planarity and ability to planarize the unevenness originating from the lower layers, and thus the insulating film 50507 is formed using an organic material in many cases. Note that a multi-layer structure in which an organic material is formed over an inorganic material (such as silicon oxide, silicon nitride, or silicon oxynitride) may be used. Note that a contact hole is selectively formed in the insulating film 50507. For example, a contact hole is formed on the upper surface of the drain electrode of the transistor 50521.

A conductive film 50508 is formed over the insulating film 50507 as a pixel electrode by a photolithography method, an inkjet method, a printing method, or the like. An opening portion is formed in the conductive film 50508. The opening portion formed in the conductive film 50508 can have the same function as the protrusion used in the MVA mode, because the opening portion allows liquid crystal molecules to be slanted. As the conductive film 50508, a transparent electrode which transmits light therethrough can be used. For example, an indium tin oxide (ITO) film in which tin oxide is mixed in indium oxide, an indium tin silicon oxide (ITSO) film in which silicon oxide is mixed in indium tin oxide (ITO), an indium zinc oxide (IZO) film in which zinc oxide is mixed in indium oxide, a zinc oxide film, a tin oxide film, or the like can be used. Note that IZO is a transparent conductive material formed by a sputtering method using a target material in which 2 to 20 wt % zinc oxide (ZnO) is mixed in ITO, but is not limited thereto. Alternatively, in the case of using a reflective electrode, for example, Ti, Mo, Ta, Cr, W, Al, Nd, Cu, Ag, Au, Pt, Nb, Si, Zn, Fe, Ba, Ge, or the like, or an alloy of these elements, or the like can be used. Alternatively, a two-layer structure in which Ti, Mo, Ta, Cr, or W and Al are stacked or a three-layer structure in which Al is interposed between metals such as Ti, Mo, Ta, Cr, and W may also be used.

Next, an insulating film 50509 is formed as an alignment film over the insulating film 50507 and the conductive film 50508 formed over the insulating film 50507.

Next, the sealant 50516 is formed around the pixel portion 50101, or around the pixel portion 50101 and the peripheral driver circuit portion thereof by an inkjet method or the like.

Then, the substrate 50515 on which a conductive film 50512, an insulating film 50511, a protrusion 50551, and the like are formed and the substrate 50100 are attached to each other with a spacer 50531 interposed therebetween, and a liquid crystal layer 50510 is provided between the two substrates. Note that the substrate 50515 serves as a counter substrate. The spacer 50531 may be formed by a method in which particles of several μm are dispersed or by a method in which a resin film is formed over the entire surface of the substrate and etched. Further, the conductive film 50512 serves as a counter electrode. As the conductive film 50512, materials similar to those of the conductive film 50508 can be used. In addition, the insulating film 50511 serves as an alignment film.

The FPC 50200 is provided over the conductive film 50518 electrically connected to the pixel portion 50101 and the peripheral driver circuit portion thereof through an anisotropic conductor layer 50517. In addition, the IC chip 50530 is provided over the FPC 50200 through the anisotropic conductor layer 50517. That is, the FPC 50200, the anisotropic conductive layer 50517, and the IC chip 50530 are electrically connected to one another.

Note that the anisotropic conductive layer 50517 has a function of transmitting a signal and a potential input from the FPC 50200 to the pixel or the peripheral circuit. As the anisotropic conductive layer 50517, a material similar to that of the conductive film 50506, a material similar to that of the conductive film 50504, a material similar to that of the impurity region of the semiconductor film 50502, or a film including at least two or more of the above layers may be used.

When a functional circuit (such as memory or buffer) is formed in the IC chip 50530, an area of the substrate can be efficiently utilized.

Note that FIG. 9B illustrates the cross-sectional structure of the MVA display mode; however, display may be conducted with a patterned vertical alignment (PVA) mode. In the case of using the PVA mode, a slit may be provided for the conductive film 50512 formed over the substrate 50515, so that liquid molecules can be slanted to be aligned. Further, a protrusion 50551 (also referred to an alignment control protrusion) is provided for a conductive film provided with a slit, so that liquid crystal molecules may be slanted to be aligned. In addition, as a driving mode of liquid crystal, without limitation to the MVA mode or the PVA mode, a TN (twisted nematic) mode, an IPS (in-plane-switching) mode, an FFS (fringe field switching) mode, an ASM (axially symmetric aligned micro-cell) mode, an OCB (optical compensated birefringence) mode, an FLC (ferroelectric liquid crystal) mode, an AFLC (antiferroelectric liquid crystal) mode, or the like can be used.

Figure 10B:
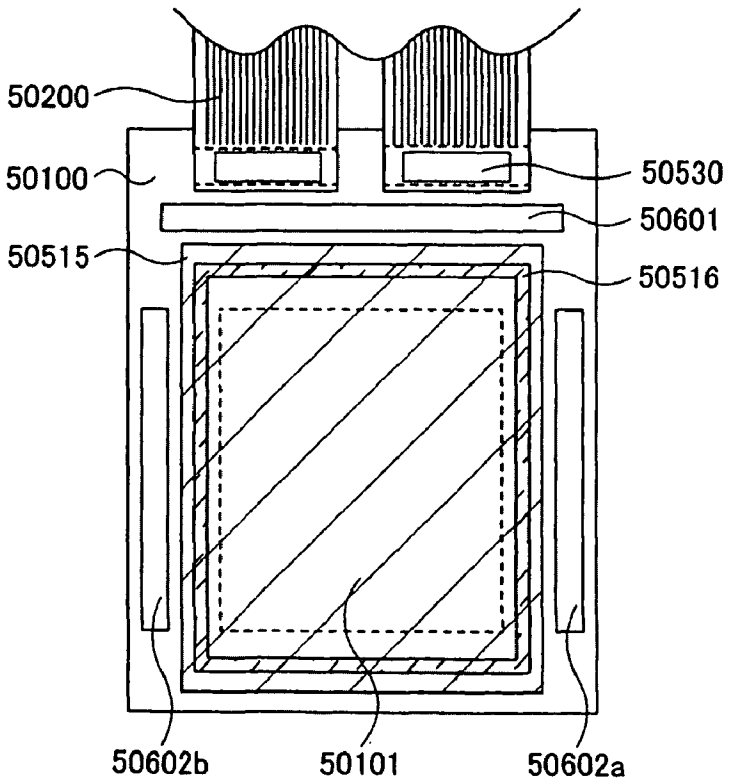
FIGS. 10A and 10B are diagrams illustrating a display device of the present invention.
Figure 10A:
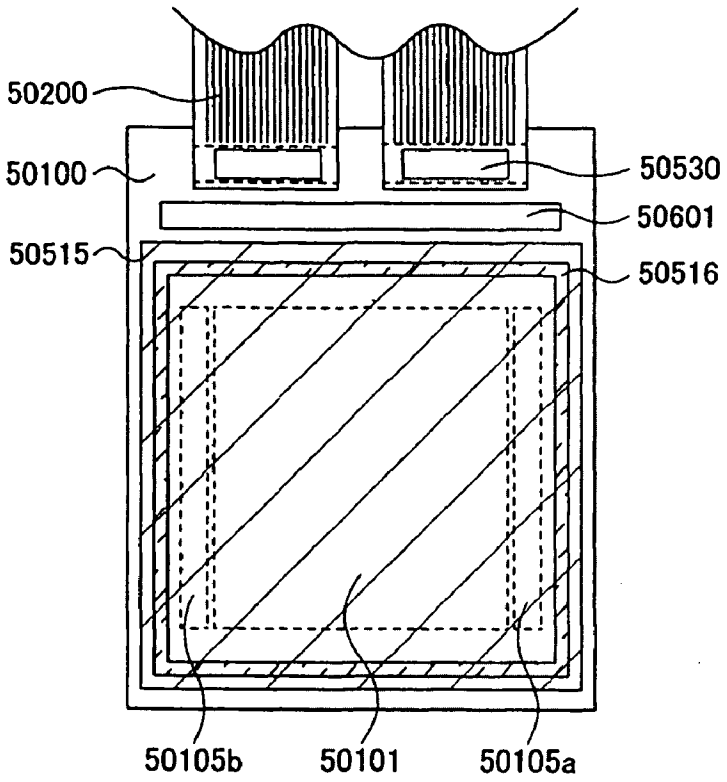

Although the first scan line driver circuit 50105*a*, the second scan line driver circuit 50105*b*, and the signal line driver circuit 50106 are formed over the substrate 50100 in the liquid crystal panel of FIGS. 9A and 9B, a driver circuit corresponding to the signal line driver circuit 50106 may be formed in a driver IC 50601 and mounted on a liquid crystal panel by a COG method as shown in the liquid crystal panel in FIG. 10A. The signal line driver circuit 50106 is formed in the driver IC 50601, whereby power savings can be achieved. In addition, when the driver IC 50601 is formed as a semiconductor chip such as a silicon wafer, a high speed operation and low power consumption of the liquid crystal panel in FIG. 10A can be achieved.

Similarly, as shown in a liquid crystal panel in FIG. 10B, driver circuits corresponding to the first scan line driver circuit 50105*a*, the second scan line driver circuit 50105*b*, and the signal line driver circuit 50106 may be formed in a driver IC 50602*a*, a driver IC 50602*b*, and a driver IC 50601, respectively, and mounted on the liquid crystal panel by a COG method, by which lower costs can be achieved.

In the present invention, the number of signal lines connected to pixels which forms a display portion illustrated in above-mentioned FIGS. 4A to 4C can be reduced. Therefore, an area of a display region which is connected to a transistor in the pixel can be increased. In the signal line driver circuit connected to the signal line, the number of elements, the cost, and power consumption can be reduced.

This embodiment mode can be arbitrarily combined with another embodiment mode.

(Embodiment Mode 4)

In this embodiment mode, examples of electronic devices are described.

Figure 11:
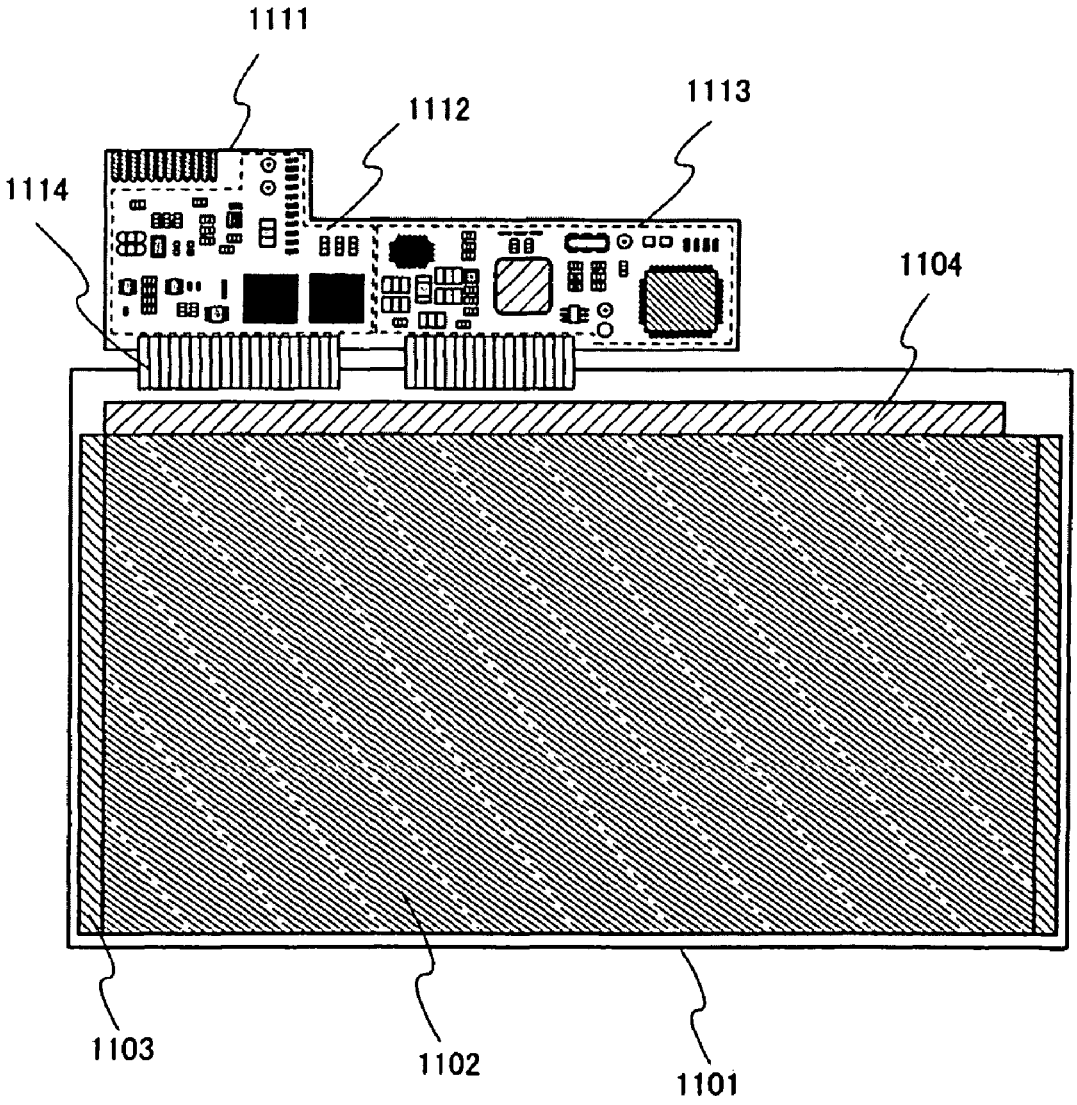
FIG. 11 is a diagram illustrating an electronic device including a display device of the present invention.

FIG. 11 illustrates a display panel module in which a display panel 1101 and a circuit board 1111 are combined. The display panel 1101 includes a pixel portion 1102, a scan line driver circuit 1103, and a signal line driver circuit 1104. The circuit board 1111 is provided with a control circuit 1112, a signal dividing circuit 1113, and the like, for example. The display panel 1101 and the circuit board 1111 are connected through a connection wiring 1114. An FPC or the like can be used for the connection wiring.

In the display panel 1101, the pixel portion 1102 and part of peripheral driver circuits (a driver circuit having a low operation frequency among a plurality of driver circuits) may be formed over the same substrate using transistors, and other part of the peripheral driver circuits (a driver circuit having a high operation frequency among the plurality of driver circuits) may be formed over an IC chip. Then, the IC chip may be mounted on the display panel 1101 by COG (chip on glass) or the like. Thus, the area of the circuit board 1111 can be reduced, and a small display device can be obtained. Alternatively, the IC chip may be mounted on the display panel 1101 by using TAB (tape automated bonding) or a printed wiring board. Thus, the area of the display panel 1101 can be reduced, and a display device with a narrower frame can be obtained.

For example, in order to reduce power consumption, a pixel portion may be formed over a glass substrate by using transistors, and all peripheral circuits may be formed over an IC chip. Then, the IC chip may be mounted on a display panel by COG or TAB.

A television receiver can be completed with the display panel module illustrated in FIG. 11.

The contents (or part of the contents) described in each drawing in this embodiment mode can be applied to various electronic devices. Specifically, the contents can be applied to a display portion of an electronic device. As examples of such an electronic device, a video camera, a digital camera, a goggle-type display, a navigation system, an audio reproducing device (such as a car audio component and an audio component), a computer, a game machine, a portable information terminal (such as a mobile computer, a mobile phone, a mobile game machine, and an electronic book), an image reproducing device provided with a recording medium (specifically, a device which reproduces contents of a recording medium such as a digital versatile disc (DVD) and has a display for displaying the reproduced image) or the like can be given.

Figure 12A:
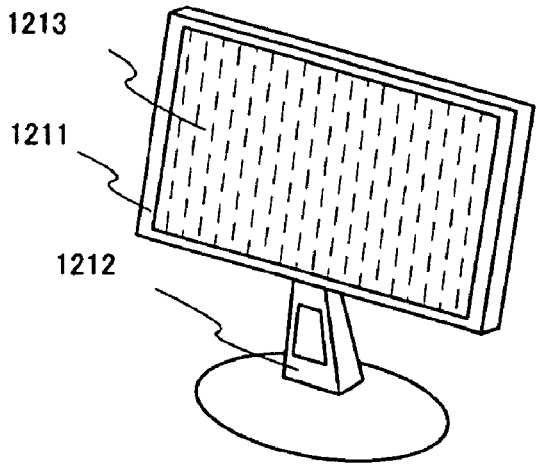
FIGS. 12A to 12C are diagrams illustrating electronic devices including a display device of the present invention.

FIG. 12A is a display which includes a housing 1211, a support base 1212, and a display portion 1213. The display illustrated in FIG. 12A has a function of displaying various kinds of information (e.g., a still image, a moving image, and a text image) on the display portion. Note that the function of the display illustrated in FIG. 12A is not limited to this function, and various functions can be included.

Figure 12B:
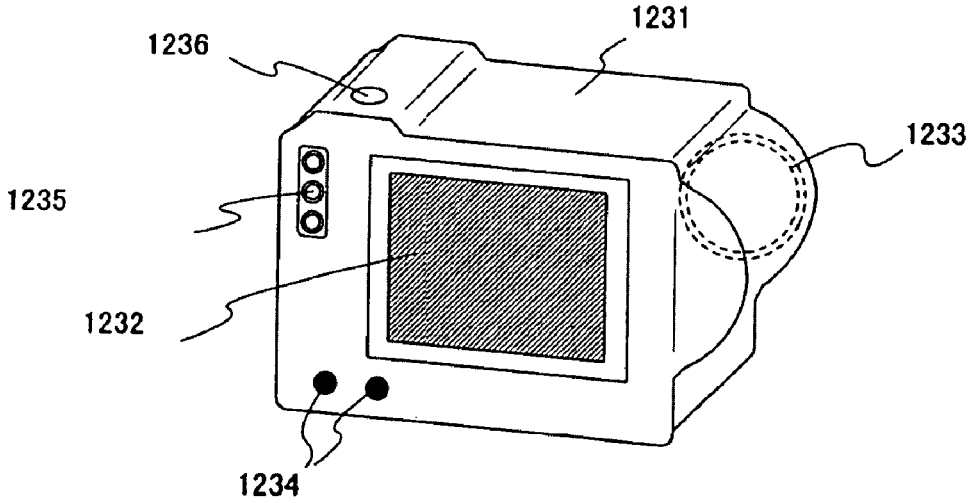

FIG. 12B is a camera which includes a main body 1231, a display portion 1232, an image receiving portion 1233, operation keys 1234, an external connection port 1235, and a shutter button 1236. The camera illustrated in FIG. 12B has various functions such as function of photographing a still image or a moving image. Note that the functions of the camera has is not limited to this function, and various functions can be included.

Figure 12C:
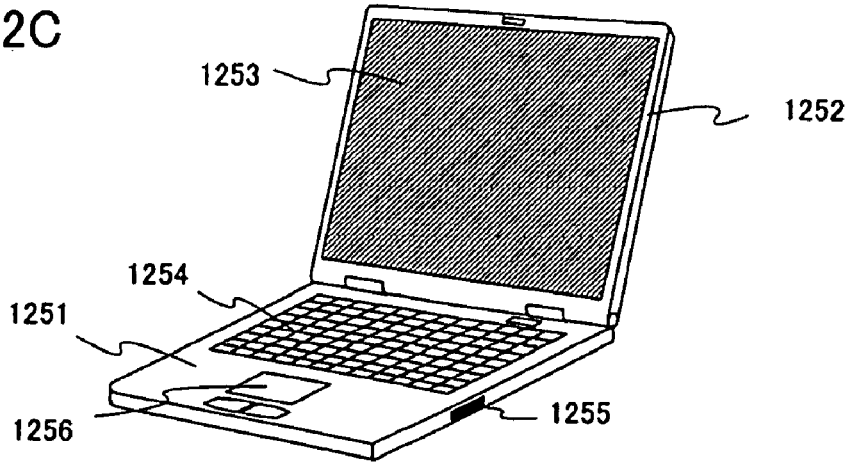

FIG. 12C illustrates a computer which includes a main body 1251, a housing 1252, a display portion 1253, a keyboard 1254, an external connection port 1255, and a pointing device 1256. The computer illustrated in FIG. 12C has function of displaying various kinds of information (e.g., a still image, a moving image, and a text image) on the display portion. Note that the function of the computer has is not limited to this function, and various functions can be included.

In the present invention, the number of signal lines connected to pixels which forms the display portion illustrated in FIGS. 12A to 12C can be reduced. Therefore, an area of a display region which is connected to a transistor in the pixel can be increased. In the signal line driver circuit connected to the signal line, the number of elements, cost, and power consumption can be reduced.

This embodiment mode can be arbitrarily combined with another embodiment mode.

This application is based on Japanese Patent Application serial No. 2007-271896 filed with Japan Patent Office on Oct. 19, 2007, the entire contents of which are hereby incorporated by reference.

The invention claimed is:

1. A display device comprising a pixel group, the pixel group comprising:

first to third pixels arranged in a same row, each of the first to third pixels comprising first and second transistors and a display element; and a signal line, a first scan line, and a second scan line, wherein a first electrode of the first transistor of the first pixel, a first electrode of the first transistor of the second pixel, and a first electrode of the first transistor of the third pixel are connected to the signal line, wherein a second electrode of the first transistor of the first pixel, a second electrode of the first transistor of the second pixel, and a second electrode of the first transistor of the third pixel are connected to a first electrode of the second transistor of the first pixel, a first electrode of the second transistor of the second pixel, and a first electrode of the second transistor of the third pixel, respectively, wherein a second electrode of the second transistor of the first pixel, a second electrode of the second transistor of the second pixel, and a second electrode of the second transistor of the third pixel are connected to the display element of the first pixel, the display element of the second pixel, and the display element of the third pixel, respectively, wherein a gate of the second transistor of the first pixel, a gate of the first transistor of the third pixel, and a gate of the second transistor of the third pixel are connected to the first scan line, and wherein a gate of the first transistor of the first pixel, a gate of the first transistor of the second pixel, and a gate of the second transistor of the second pixel are connected to the second scan line.

2. A display device comprising a pixel group, the pixel group comprising:

first to third pixels arranged in a same row, each of the first to third pixels comprising first to third transistors and a display element; and a signal line, a first scan line, a second scan line, and a power supply line, wherein a first electrode of the first transistor of the first pixel, a first electrode of the first transistor of the second pixel, and a first electrode of the first transistor of the third pixel are connected to the signal line, wherein a second electrode of the first transistor of the first pixel, a second electrode of the first transistor of the second pixel, and a second electrode of the first transistor of the third pixel are connected to a first electrode of the second transistor of the first pixel, a first electrode of the second transistor of the second pixel, and a first electrode of the second transistor of the third pixel, respectively, wherein a second electrode of the second transistor of the first pixel, a second electrode of the second transistor of the second pixel, and a second electrode of the second transistor of the third pixel are connected to a gate of the third transistor of the first pixel, a gate of the third transistor of the second pixel, a gate of the third transistor of the third pixel, respectively, wherein a first electrode of the third transistor of the first pixel, a first electrode of the third transistor of the second pixel, and a first electrode of the third transistor of the third pixel are connected to the power supply line, wherein a second electrode of the third transistor of the first pixel, a second electrode of the third transistor of the second pixel, and a second electrode of the third transistor of the third pixel are connected to the display element of the first pixel, the display element of the second pixel, the display element of the third pixel, respectively, wherein a gate of the second transistor of the first pixel, a gate of the first transistor of the third pixel, and a gate of the second transistor of the third pixel are connected to the first scan line, and wherein a gate of the first transistor of the first pixel, a gate of the first transistor of the second pixel, and a gate of the second transistor of the second pixel are connected to the second scan line.

3. The display device according to claim 1, wherein the display element is a liquid crystal element.

4. The display device according to claim 1, wherein each of the display element of the first pixel, the display element of the second pixel, and the display element of the third pixel is arranged to be a color element.

5. The display device according to claim 1, wherein the display element of the first pixel, the display element of the second pixel, and the display element of the third pixel are arranged to be a first color element, a second color element, and third color element, respectively.

6. The display device according to claim 1, wherein the display element of the first pixel, the display element of the second pixel, and the display element of the third pixel are arranged to be an element of a first color, an element of a second color, and an element of a third color, respectively, and wherein the first color, the second color, and the third color are different from one another.

7. The display device according to claim 2, wherein the display element is a light emitting element.

8. The display device according to claim 2, wherein each of the display element of the first pixel, the display element of the second pixel, and the display element of the third pixel is arranged to be a color element.

9. The display device according to claim 2, wherein the display element of the first pixel, the display element of the second pixel, and the display element of the third pixel are arranged to be a first color element, a second color element, and third color element, respectively.

10. The display device according to claim 2, wherein the display element of the first pixel, the display element of the second pixel, and the display element of the third pixel are arranged to be an element of a first color, an element of a second color, and an element of a third color, respectively, and wherein the first color, the second color, and the third color are different from one another.

11. A method for driving a display device which comprises first to third pixels, the method comprising:

arranging first and second transistors of the first pixel, first and second transistors of the second pixel, and first and second transistors of the third pixel in an ON state in a first period; arranging the first transistor of the first pixel and the first and second transistors of the second pixel in the ON state and the second transistor of the first pixel and the first and second transistors of the third pixel in an OFF state in a second period; and arranging the first transistor of the first pixel and the first and second transistors of the second pixel in the OFF state and the second transistor of the first pixel and the first and second transistors of the third pixel in the ON state in a third period, wherein the first to third pixels are arranged in the same row, wherein a first electrode of the first transistor in the first pixel, a first electrode of the first transistor in the second pixel, and a first electrode of the first transistor in the third pixel are connected to a signal line, and wherein a second electrode of the first transistor in the first pixel, a second electrode of the first transistor in the second pixel, and a second electrode of the first transistor in the third pixel are connected to a first electrode of the second transistor in the first pixel, a first electrode of the second transistor in the second pixel, and a first electrode of the second transistor in the third pixel, respectively.

12. The display device according to claim 11, wherein the first to third pixels each comprise a liquid crystal element.

13. The display device according to claim 11, wherein the first to third pixels each comprise a light emitting element.

14. The display device according to claim 11, wherein the first pixel, the second pixel, and the third pixel are arranged to be a first color element, a second color element, and third color element, respectively.

15. The display device according to claim 11, wherein the first pixel, the second pixel, and the third pixel are arranged to be an element of a first color, an element of a second color, and an element of a third color, respectively, and wherein the first color, the second color, and the third color are different from one another.

16. The display device according to claim 11, wherein each of the first to third period is equal to or less than $1/180$M second, where M is a number of scan lines provided with the display device.

* * * * *